United States Patent [19]

Isozumi

[11] Patent Number: 4,947,052

[45] Date of Patent: Aug. 7, 1990

[54] COAXIAL ENGINE STARTER

[75] Inventor: Shuzoo Isozumi, Himeji City, Japan

[73] Assignee: Mitsubishi Denki Kabushiki Kaisha, Tokyo, Japan

[21] Appl. No.: 296,660

[22] Filed: Jan. 13, 1989

[30] Foreign Application Priority Data

Jan. 13, 1988 [JP] Japan ..... 63-6122

[51] Int. Cl.[5] ..... F02N 15/00

[52] U.S. Cl. ..... 290/48; 74/7 C

[58] Field of Search ..... 290/38 R, 48; 74/7 R, 74/7 A, 7 C, 7 E

[56] References Cited

U.S. PATENT DOCUMENTS 4,760,274 7/1988 Isozumi ..... 290/48

4,808,836 2/1989 Isozumi et al. ..... 290/48

FOREIGN PATENT DOCUMENTS 1311876 11/1962 France .

*Primary Examiner*—A. D. Pellinen

*Assistant Examiner*—W. E. Duncanson, Jr.

*Attorney, Agent, or Firm*—Sughrue, Mion, Zinn, Macpeak and Seas

[57] ABSTRACT

A coaxial engine starter comprises an electric motor having a tubular armature rotary shaft and an output rotary shaft disposed at the front end of the electric motor and having at one end a pinion capable of engaging and disengaging an engine ring gear and axially slidably inserted into an inner bore of the armature rotary shaft at the other end. A planetary speed reduction gear including a sun gear formed around the outer periphery of the front end of the armature rotary shaft and a plurality of planetary gears meshing with the sun gear for reducing rotational speed of the armature rotary shaft is provided and an over-running clutch fitted on the output rotary shaft for transmitting the rotation of the armature rotary shaft transmitted through the planetary speed reduction gear to the output rotary shaft, the over-running clutch having a clutch inner member including a front end surface which abuts against a rear end surface of the pinion when output rotary shaft is moved rearward. The coaxial starter further comprises a bearing disposed at a small-diameter step portion formed adjacent to the front end of the sun gear in the outer peripheral portion of the armature rotary shaft and inserted into a clutch outer member, and a spacer portion interposed between the rear end surface of the clutch inner member of the over-running clutch and the side surface of the bearing for transmitting an axial impact applied to the clutch inner member also to the bearing.

1 Claim, 3 Drawing Sheets

COAXIAL ENGINE STARTER

BACKGROUND OF THE INVENTION

This invention relates to a coaxial engine starter and, more particularly, to a coaxial engine starter for a vehicular engine.

The conventional vehicular engine starter is constructed as illustrated in FIG. 1. The conventional engine starter 1 shown in FIG. 1 comprises a d.c. motor 2, an over-running clutch 4 slidably fitted over an output rotary shaft 3, a planetary speed reduction gear 5 for reducing the rotational force of the armature rotary shaft 2*a* of the d.c. motor 2 to transmit it to the clutch outer member 4*a* of the over-running clutch 4 through the output rotary shaft 3, and a shift lever 8 for sliding the over-running clutch 4 along the output rotary shaft 3, the shift lever 8 engaging at its one end with the plunger rod of a solenoid switch 6 mounted on a side of the d.c. motor 2 and being connected at its the other end to an annular member 7 mounted to the over-running clutch 4.

However, in the conventional engine starter as shown in FIG. 1, the solenoid switch 6 for moving the shift lever 8 and for closing electrical contacts connecting an electrical source to the d.c. motor 2 is positioned on one side of the d.c. motor 2 in a parallel, side-by-side relationship and the shift lever 8 must be provided for slidably moving the over-running clutch 4 along the output rotary shaft 3 into engagement with the engine ring gear. Therefore, with the conventional starter, the engine layout in the engine compartment of a vehicle is restricted due to the structure and the configuration of the starter.

In order to eliminate the above disadvantages, a coaxial engine starter 10 as shown in FIG. 2 has been proposed, in which the solenoid switch is coaxially positioned at one axial end of the d.c. motor so that the overall starter configuration may become a simple elongated cylinder. According to the coaxial engine starter 10 of this proposition, a d.c. electric motor 11 has a hollow armature rotary shaft 12 and a plunger rod 13*a* of a solenoid switch 13 positioned at the rear end of the d.c. motor 11 is inserted into an inner passage 12*a* of the armature rotary shaft 12 so that the inserted front end of the plunger rod 13*a* abuts against the rear end of an output rotary shaft 14 coaxially disposed at the front end of the armature rotary shaft 12 and inserted into the inner passage 12*a* of the armature rotary shaft 12, whereby the output rotary shaft 14 can be pushed forward.

It is seen that a sun gear 15*a* is formed on the outer circumference of the front end of the armature rotary shaft 12 and a plurality of planetary gears 15*b* are in mesh with the sun gear 15*a*. These planetary gears 15*a* also mesh with an inner gear 15*c* formed in the inner circumferential surface of the frame 16 and are rotatably supported by shafts 15*d* secured on a carrier 15*e*. The sun gear 15*a*, the planetary gears 15*b*, the inner gear 15*c*, the shafts 15*d* and the carrier 15*e* together constitute a planetary speed reduction gear 15 which reduces the rotational speed of the armature rotary shaft 12. On the output rotary shaft 14, an over-running clutch 17 is fitted, of which clutch inner member 17*a* is engaged with the output rotary shaft 14 by helical splines 14*b* of spline formation portion 14*a* having an outer diameter larger than the inner diameter of the inner passage 12*a* of the armature rotary shaft 12, so that the output rotary shaft 14 is allowed to axially slide while being rotated by the clutch inner member 17*a*. On the front end of the output rotary shaft 14, a pinion 18 which engages and disengages relative to the engine ring gear (not shown). When the output rotary shaft 14 is moved forward, the pinion 18 meshes the engine ring gear to rotate the engine.

However, since it is very difficult to precisely axially align the planetary speed reduction gear 15 and the armature rotary shaft 12, they are often misaligned or brought into a non-coaxial relationship which brings about a very unstable condition. Therefore, the planetary gears 15*b* can be destroyed or the planetary speed reduction gear 15 can make a noise during a high speed rotation or when a large impact is applied. Particular in the case of a coaxial starter, since the shafts 15*d* for rotatably supporting the planetary gears 5*b* are secured to the carrier integrally formed in the clutch outer member 17*b* of the over-running clutch 17, the clutch outer member 17*b* can also be misaligned, resulting in the formation of hit marks on cum surfaces of the over-running clutch 17.

Further, in order to provide a stop for limiting the rearward movement of the output rotary shaft 14 beyond a certain point, the front end of the armature rotary shaft 12 is defined so that it abuts the rear end surface of the spline formation portion 14*a* of the output rotary shaft 14. However, since there is a relative rotation between the armature rotary shaft 12 and the output rotary shaft 14, the engaging surfaces are very quickly worn, posing a problem that an accurate stop position of the output rotary shaft is difficult to maintain.

SUMMARY OF THE INVENTION

Accordingly, one of the objects of the present invention is to provide a coaxial engine starter free from the above-discussed problems.

Another object of the present invention is to provide a coaxial engine starter in which alignment of the planetary speed reduction gear and the rotary shaft of the over-running clutch can be easily maintained.

Still another object of the present invention is to provide a coaxial engine starter in which the accurate rearward stop position of the output rotary shaft can be maintained.

With the above objects in view, the coaxial engine starter of the present invention comprises an electric motor having a tubular armature rotary shaft and an output rotary shaft disposed at the front end of the electric motor and having at one end a pinion capable of engaging and disengaging an engine ring gear and axially slidably inserted into an inner bore of the armature rotary shaft at the other end. A planetary speed reduction gear including a sun gear formed around the outer periphery of the front end of the armature rotary shaft and a plurality of planetary gears meshing with the sun gear for reducing the rotational speed of the armature rotary shaft is provided and an over-running clutch fitted on the output rotary shaft for transmitting the rotation of the armature rotary shaft transmitted through the planetary speed reduction gear to the output rotary shaft, the over-running clutch having a clutch inner member including a front end surface which abuts against a rear end surface of the pinion when output rotary shaft is moved rearward. The coaxial starter further comprises a bearing disposed at a small-diameter step portion formed adjacent to the front end of the sun gear in the outer peripheral portion of the armature rotary shaft and inserted into a clutch outer member, and a spacer portion interposed between the rear end surface of the clutch inner member of the over-running clutch and the side surface of the bearing for transmitting an axial impact applied to the clutch inner member also to the bearing.

With the coaxial engine starter of the present invention, since the carrier for the planetary speed reduction gear which is integral with the clutch outer member of the over-running clutch is supported by a bearing with respect to the armature rotary shaft, the misalignment of the armature rotary shaft relative to the central axis is restricted, and also the rearward movement of the output rotary shaft is limited by the abutment of the pinion on the output rotary shaft against one end surface of the clutch inner member, and the other end surface of the clutch inner member is supported by the bearing through the spacer portion.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
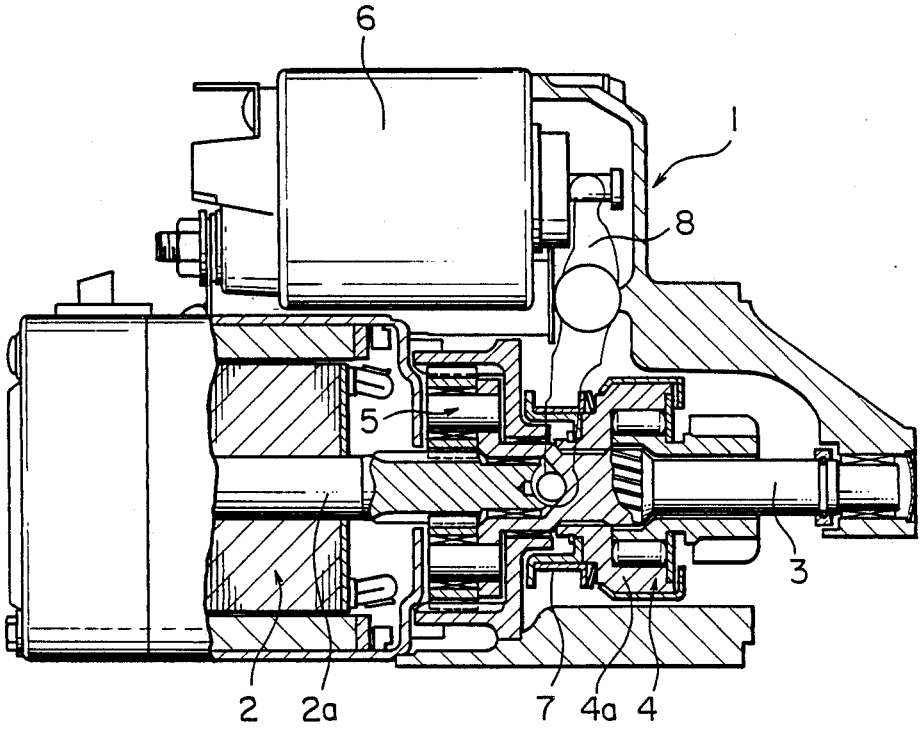
FIG. 1 PRIOR ART
FIG. 1 is a sectional view of the conventional engine starter in which the starter motor and the solenoid switch are arranged side-by-side.
Figure 3:
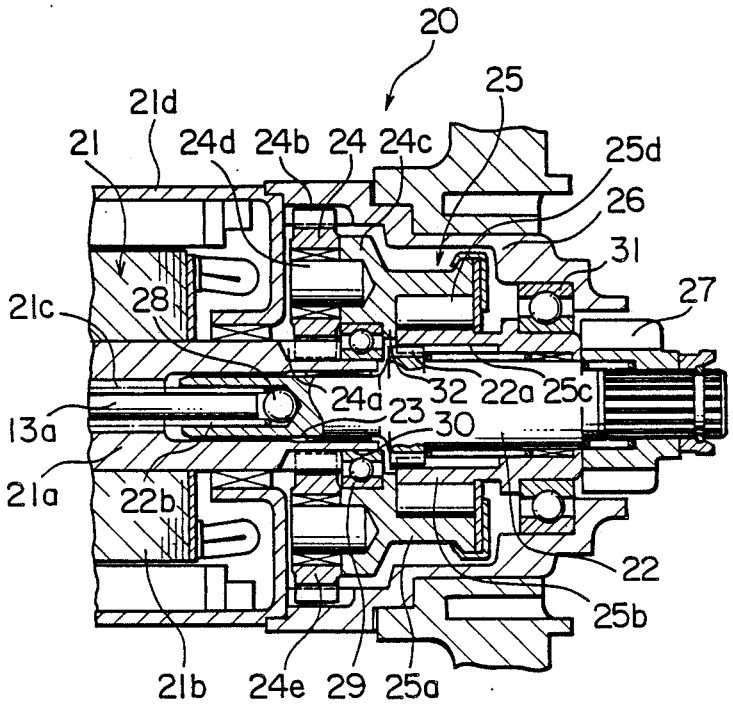
FIG. 3 is a fragmental sectional view of a coaxial engine starter of one embodiment of the present invention.

FIG. 3 illustrates a coaxial engine starter 20 of one embodiment of the present invention which comprises a d.c. motor 21 having a yoke **21*d* serving as a frame of the starter and a tubular armature rotary shaft 21*a* coaxially disposed within the yoke 21*d*. An armature core 21*b* is press-fitted over the outer circumference of the tubular armature rotary shaft 21*a*. On one axial end side (on the right as viewed in FIG. 1) of the d.c. motor 21, an output rotary shaft 22 is disposed in a coaxial relationship with the armature rotary shaft 21*a*. The output rotary shaft 22 is inserted at its one end into the inner passage 21*c* of the armature rotary shaft 21*a* and axially slidably supported by a sleeve bearing 23 disposed between the output rotary shaft 22 and the inner surface of the hollow armature rotary shaft 21*a***.

The rotation of the armature rotary shaft **21*a* is transmitted to the output rotary shaft 22 through a planetary speed reduction gear 24 and an over-running clutch 25. That is, the planetary speed reduction gear 24 comprises a sun gear 24*a* integrally formed on the outer circumference of one end of the armature rotary shaft 21*a*, an inner gear 24*b* formed in the front bracket 26 which is a frame member of the starter 20, and a plurality of planetary gears 24*e* rotatably supported by shafts 24*d* on a carrier 24*c* integral with the clutch outer member 25*a* of the over-running clutch 25 and in mesh with the sun gear 24*a* and the inner gear 24*b*. Also, helical splines 25*c* formed in the inner circumferential surface of the clutch inner member 25*b* of the over-running clutch 25 are engaged with helical splines 22*a* formed on the outer circumferential surface of the output rotary shaft 22, so that the output rotary shaft 22 is permitted to slide in the axial direction while it can rotate by the rotational force transmitted from the clutch inner member 25*b*. On the front end of the output rotary shaft 22 projecting from the front bracket 26, a pinion 27** is disposed for engagement with the ring gear of the engine.

Figure 2:
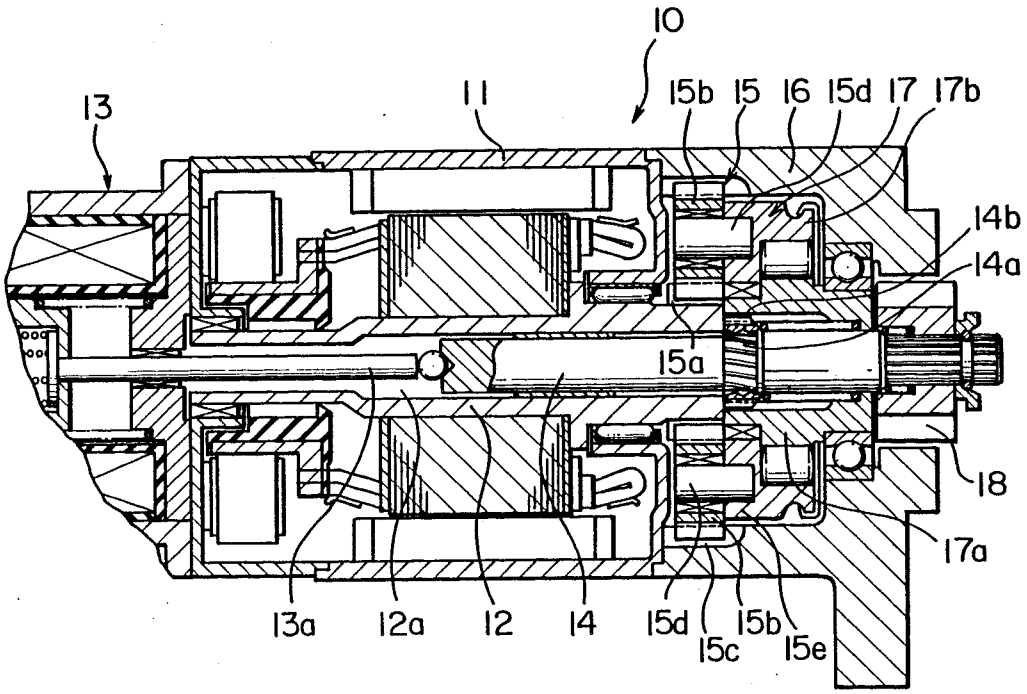
FIG. 2 is a sectional view of a coaxial engine starter to which the present invention can be applied.

On the other end side (on the left as viewed in FIG. 1) of the d.c. motor 21, a solenoid switch 13 is mounted. The function of this solenoid switch 13 is similar to that of the solenoid switch shown in FIG. 2. When the ignition switch of the vehicle is closed, the solenoid electromagnetically drives the rod **13*a* by the plunger to push forward the output rotary shaft 22, whereby the pinion 27 is brought into engagement with the engine ring gear and the d.c. motor 21** is energized.

In the coaxial engine starter 20, although not illustrated, a rod **13*a* is operatively connected to a plunger (not shown) of the solenoid switch 13 axially aligned with respect to the armature rotary shaft 21*a* of the d.c. motor 21. The rod 13*a* extends through the central bore or the inner passage 21*c* of the armature rotary shaft 21*a* and abuts against the bottom surface of the bore 22*b* of the output rotary shaft 22 through a steel ball 28**.

Further, according to the present invention, the carrier **24*c* of the planetary speed reduction gear 24 is rotatably supported on the armature rotary shaft 21*a* by a ball bearing 29. The ball bearing 29 is fitted into the inner periphery of the center hole of the carrier 24*c* and placed over a small-diameter portion 30 formed in the outer periphery of the armature rotary shaft 21*a* at the front end portion adjacent to the sun gear 24*a* formed on the armature rotary shaft 21*a*. Thus, the carrier 24*c* is substantially completely prevented by the ball bearing 29 from being moved in the radial direction to be off center, so that no eccentricity of the carrier 24*c* occurs. Further, a clutch inner member 25*b* of the over-running clutch 25 is extended at its front end toward the pinion 27 to provide an extension on which a bearing 31 is placed. The outer circumferential surface of this bearing 31 is held by the front bracket 26. Therefore, the axis of rotation of the planetary gears 24*e*, the axis of rotation of the over-running clutch 25 and the central axis of the armature rotary shaft 21*a*** are all in alignment or coincide, thereby to eliminate the possibility of eccentricity of these components.

Further, a spacer 32 is disposed between the rear end of the clutch inner member **25*b* of the over-running clutch 25 and the front end surface of the outer race of the ball bearing 29 to prevent the direct contact of the clutch inner member 25*b* and the bearing 29. In the illustrated embodiment, the spacer 32 is a radially inwardly extending flange extending from the clutch outer member 25*a* which is integral with the carrier 24*c*. It is also seen that the front end of the clutch inner member 25*b* of the over-running clutch 25 is so positioned as to abut the rear end of the pinion 27 when the output rotary shaft 22** is in its rearward position.

When an unillustrated ignition switch is closed to energize an excitation coil of the solenoid switch, the rod **13*a* is driven forward (to the right as seen in FIG. 3) by an electromagnetic force generated by the excitation of the solenoid switch. Therefore, the output rotary shaft 22 is pushed forward to cause the pinion 27 disposed at its front end to be brought into engagement with the ring gear of the engine. At this time, although not illustrated, a movable contact is brought into contact with stationary contacts to supply electrical power to the d.c. motor 21 to drive it. Therefore, the rotation of the armature rotary shaft 21***a* is speed-reduced by the planetary speed reduction gear 24 and is transmitted to the clutch outer member 25*a* of the over-running clutch 25, and the rotation of the clutch outer member 25*a* is transmitted to the clutch inner member 25*b* through a plurality of rollers 25*d*. Then this rotation of the clutch inner member 25*b* is transmitted to the output rotary shaft 22 by the helical splines 22*a* and 25*c* to rotate the pinion 27, whereby the engine ring gear is driven by the pinion 27 to start the engine.

After the engine has been started, the backward driving of the starter is prevented by the over-running clutch 25, and the output rotary shaft 22, the plunger of the solenoid switch and the rod 13*a* are returned to their home positions by the respective return springs. During the returning of the output rotary shaft 22, the rear end surface of the pinion 27 abuts against the front end surface of the clutch inner member 25*b* of the over-running clutch 25 at a predetermined stop position. The forced applied to the clutch inner member 25*b* from the pinion 27 is transmitted from the rear end surface of the clutch inner member 25*b* to the front end surface of the outer race of the ball bearing 29 through the spacer 32. In other words, the stop position of the output rotary shaft 22 during its backward movement is determined by the above-described abutment.

With the coaxial engine starter of the present invention, since the carrier 24*c* for supporting the planetary gears 24*e* of the planetary speed reduction gear 25 which is integral with the clutch outer member 25*a* of the over-running clutch 24 is supported by a ball bearing 29 on the small-diameter portion of the armature rotary shaft 21*a*, the misalignment or the off-centering of various components and particularly the planetary speed reduction gear 24 and the over-running clutch 25 the armature rotary shaft 21*a* relative to the central axis is restricted. Further, the rearward movement of the output rotary shaft 22 is stopped by pressing the spacer flange 32 against the ball bearing 29 on the output rotary shaft 22 through the clutch inner member 25*b* by utilizing the pinion 27, reducing the wear of the abutting components.

As has been described, according to the coaxial engine starter of the present invention the over-running clutch and the planetary speed reduction gear are maintained to be coaxial with the armature rotary shaft to ensure a stable operation. Also, the stopping position can be made significantly accurate and is reliable because of the low-pitch.

What is claimed is:

1. A coaxial engine starter comprising an electric motor having a tubular armature rotary shaft;

an output rotary shaft disposed at the front end of said electric motor and having at one end a pinion capable of engaging and disengaging an engine ring gear and axially slidably inserted into an inner bore of said armature rotary shaft at the other end;

a planetary speed reduction gear including a sun gear formed around the outer periphery of the front end of said armature rotary shaft and a plurality of planetary gears meshing with said sun gear for reducing the rotational speed of said armature rotary shaft;

an over-running clutch fitted on said output rotary shaft for transmitting the rotation of said armature rotary shaft transmitted through said planetary speed reduction gear to said output rotary shaft, said over-running clutch having a clutch inner member including a front end surface which abuts against a rear end surface of said pinion when output rotary shaft is moved rearward;

a bearing disposed at a small-diameter step portion formed adjacent to the front end of said sun gear in the outer peripheral portion of said armature rotary shaft and inserted into a clutch outer member; and a spacer portion interposed between the rear end surface of said clutch inner member of said over-running clutch and the side surface of said bearing for transmitting an axial impact applied to said clutch inner member also to said bearing.

* * * * *